US009222302B2

(12) United States Patent
Black

(10) Patent No.: US 9,222,302 B2
(45) Date of Patent: Dec. 29, 2015

(54) FENESTRATION COVERING LIFT SYSTEM AND METHOD

(71) Applicant: Randy Lee Black, Newton, IA (US)

(72) Inventor: Randy Lee Black, Newton, IA (US)

(73) Assignee: Pella Corporation, Pella, IA (US)

( * ) Notice: Subject to any disclaimer, the term of this patent is extended or adjusted under 35 U.S.C. 154(b) by 54 days.

(21) Appl. No.: 14/141,649

(22) Filed: Dec. 27, 2013

(65) Prior Publication Data

US 2015/0184452 A1 Jul. 2, 2015

(51) Int. Cl.
*E06B 9/303* (2006.01)

(52) U.S. Cl.
CPC ..... *E06B 9/303* (2013.01)

(58) Field of Classification Search
CPC ..... E06B 9/30; E06B 9/303; E06B 9/307; E06B 9/308; E06B 9/322
USPC ..... 160/170, 171
See application file for complete search history.

(56) References Cited

U.S. PATENT DOCUMENTS

| | | | | |
|---|---|---|---|---|
| 4,200,135 | A * | 4/1980 | Hennequin | 160/168.1 R |
| 4,697,630 | A | 10/1987 | Rude | |
| 5,074,349 | A | 12/1991 | Yannazzone | |
| 5,092,387 | A | 3/1992 | King et al. | |
| 5,123,472 | A | 6/1992 | Nagashima et al. | |
| 5,165,459 | A | 11/1992 | Gaber et al. | |
| 5,497,820 | A | 3/1996 | Drake et al. | |
| 5,662,154 | A | 9/1997 | Drake et al. | |
| 5,839,494 | A | 11/1998 | Judkins | |
| 5,921,306 | A | 7/1999 | Smederod | |
| 5,934,350 | A | 8/1999 | Ciuca | |
| 6,076,588 | A | 6/2000 | Swiszcz et al. | |
| 6,164,362 | A | 12/2000 | Yang | |
| 6,302,182 | B1 | 10/2001 | Anderson | |
| 6,470,637 | B2 | 10/2002 | Gratz | |
| 6,736,185 | B2 | 5/2004 | Smith et al. | |
| 6,889,933 | B2 | 5/2005 | Straaten et al. | |
| 6,945,302 | B2 * | 9/2005 | Nien | 160/170 |
| 6,976,522 | B2 | 12/2005 | Strand | |
| 7,100,663 | B2 | 9/2006 | Zhang et al. | |
| D530,558 | S | 10/2006 | Damiano | |
| 7,137,430 | B2 * | 11/2006 | Fraczek | 160/170 |
| 7,143,802 | B2 | 12/2006 | Strand et al. | |
| 7,287,569 | B2 * | 10/2007 | Lin | 160/170 |
| 7,311,133 | B2 | 12/2007 | Anderson et al. | |
| 7,380,582 | B1 | 6/2008 | Anderson et al. | |
| 7,571,756 | B2 | 8/2009 | Smith et al. | |
| 7,654,301 | B2 | 2/2010 | Krab et al. | |
| 7,665,503 | B2 | 2/2010 | Liu | |
| 7,665,505 | B2 | 2/2010 | McCormick et al. | |

(Continued)

FOREIGN PATENT DOCUMENTS

| | | |
|---|---|---|
| EP | 0273719 B2 | 7/1988 |
| EP | 0480429 A2 | 4/1992 |

(Continued)

*Primary Examiner* — Katherine Mitchell
*Assistant Examiner* — Scott Denion
(74) *Attorney, Agent, or Firm* — Faegre Baker Daniels LLP

(57) ABSTRACT

A window covering for a fenestration product includes a top rail, a bottom rail, and a shade extending between the top rail and the bottom rail. A shade mechanism includes a rotatable lift shaft, a lift spool having a cylinder operably connected to the top rail for raising and lowering the top rail, and a resilient member operably connected between the lift shaft and the lift spool. The resilient member allows the lift shaft to over-rotate with respect to the lift spool.

21 Claims, 6 Drawing Sheets

(56) References Cited

U.S. PATENT DOCUMENTS

| | | | | |
|---|---|---|---|---|
| 7,740,047 | B2 | 6/2010 | Koop et al. | |
| 7,886,803 | B2 | 2/2011 | Anderson et al. | |
| 7,921,897 | B2 | 4/2011 | Chou | |
| 7,926,541 | B2 | 4/2011 | Chou | |
| 8,151,859 | B2 | 4/2012 | Koop et al. | |
| 8,186,413 | B2 | 5/2012 | Fujita et al. | |
| 8,281,843 | B2 * | 10/2012 | Yu et al. | 160/170 |
| 2002/0069978 | A1 * | 6/2002 | van der Wielen | 160/176.1 R |
| 2004/0004150 | A1 | 1/2004 | Straaten et al. | |
| 2004/0011475 | A1 | 1/2004 | Smith et al. | |
| 2004/0231807 | A1 | 11/2004 | Strand | |
| 2005/0045279 | A1 | 3/2005 | Zhang et al. | |
| 2006/0225849 | A1 | 10/2006 | Krab et al. | |
| 2007/0204964 | A1 | 9/2007 | Damiano | |
| 2007/0261797 | A1 | 11/2007 | Fraser et al. | |
| 2009/0065155 | A1 | 3/2009 | Liu | |
| 2009/0220353 | A1 | 9/2009 | Schwarzkopf | |
| 2010/0084099 | A1 | 4/2010 | Chou | |
| 2010/0155000 | A1 | 6/2010 | Krab et al. | |
| 2010/0186906 | A1 * | 7/2010 | Kraler et al. | 160/168.1 P |
| 2010/0186907 | A1 * | 7/2010 | Kraler et al. | 160/176.1 P |
| 2010/0236726 | A1 | 9/2010 | Chou | |
| 2010/0243178 | A1 | 9/2010 | Chou | |
| 2011/0094687 | A1 | 4/2011 | Fraser et al. | |
| 2011/0253321 | A1 * | 10/2011 | Yu et al. | 160/170 |
| 2012/0061031 | A1 | 3/2012 | Zhang | |
| 2013/0340952 | A1 * | 12/2013 | Kao | 160/170 |
| 2014/0238622 | A1 * | 8/2014 | Patterson et al. | 160/176.1 R |
| 2015/0033910 | A1 * | 2/2015 | Steenbergen et al. | 74/99 R |

FOREIGN PATENT DOCUMENTS

| | | | |
|---|---|---|---|
| EP | 480429 | B1 | 3/1997 |
| EP | 1557524 | A2 | 7/2005 |
| EP | 2434084 | A1 | 3/2012 |
| WO | 9114848 | A1 | 10/1991 |
| WO | 9208031 | A1 | 5/1992 |
| WO | 9218738 | A1 | 10/1992 |
| WO | 9736081 | A1 | 10/1997 |
| WO | 2004009942 | A1 | 1/2004 |
| WO | 2004088085 | A1 | 10/2004 |
| WO | 2007027650 | A1 | 3/2007 |

* cited by examiner

FENESTRATION COVERING LIFT SYSTEM AND METHOD

BACKGROUND

Window coverings come in various styles and designs. One type of window covering is a shade and one type of shade is a top-down shade. A top-down shade typically includes a top rail, a bottom rail, and a shade extending between the top rail and the bottom rail. The bottom rail typically remains stationary during operation and the top rail is typically raised and lowered to raise and lower the shade. A lift mechanism is typically included to raise and lower the top rail. Because the top rail goes down to open the shade when lowered by the lift mechanism, this inspires the name "top-down shade."

The lift mechanism of the top-down shade can include a brake for holding the top rail in a desired location. In some top-down shades, the mechanism and the brake can be imprecise, making it challenging to stop the top rail exactly at a desired location. For example, in some top-down shades, when a user raises the top rail to the highest most position, the lift mechanism and brake can subsequently relax and lower the top rail. This can undesirable create a gap at the top of the window allow light to pass.

SUMMARY

According to one embodiment, a window covering for a fenestration product includes a top rail, a bottom rail, and a shade extending between the top rail and the bottom rail. A shade mechanism includes a rotatable lift shaft, a lift spool having a cylinder operably connected to the top rail for raising and lowering the top rail, and a resilient member operably connected between the lift shaft and the lift spool. The resilient member allows the lift shaft to over-rotate with respect to the lift spool.

Another embodiment is a top-down shade system including a top rail extending substantially horizontally, a bottom rail extending substantially horizontally, and a shade extending between the top rail and the bottom rail. A mounting structure is positioned above the top rail and a shade mechanism is positioned at least partially in the mounting structure. The shade mechanism includes a rotatable lift shaft, a lift spool having a cylinder connected to the top rail via a lift cord wrapped around the cylinder, and a resilient member operably connected between the lift shaft and the lift spool. The resilient member allows the lift shaft to over-rotate with respect to the lift spool.

Another embodiment is a method of operating a window covering having a shade extending between a top rail and a bottom rail. The method includes rotating in a first direction a lift shaft and a cylinder operably connected by a resilient member, raising the top rail to abut a structure above the top rail via a lift cord operably connected between the top rail and the cylinder, and over-rotating the lift shaft with respect to the cylinder by bending the resilient member to maintain tension in the lift cord.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
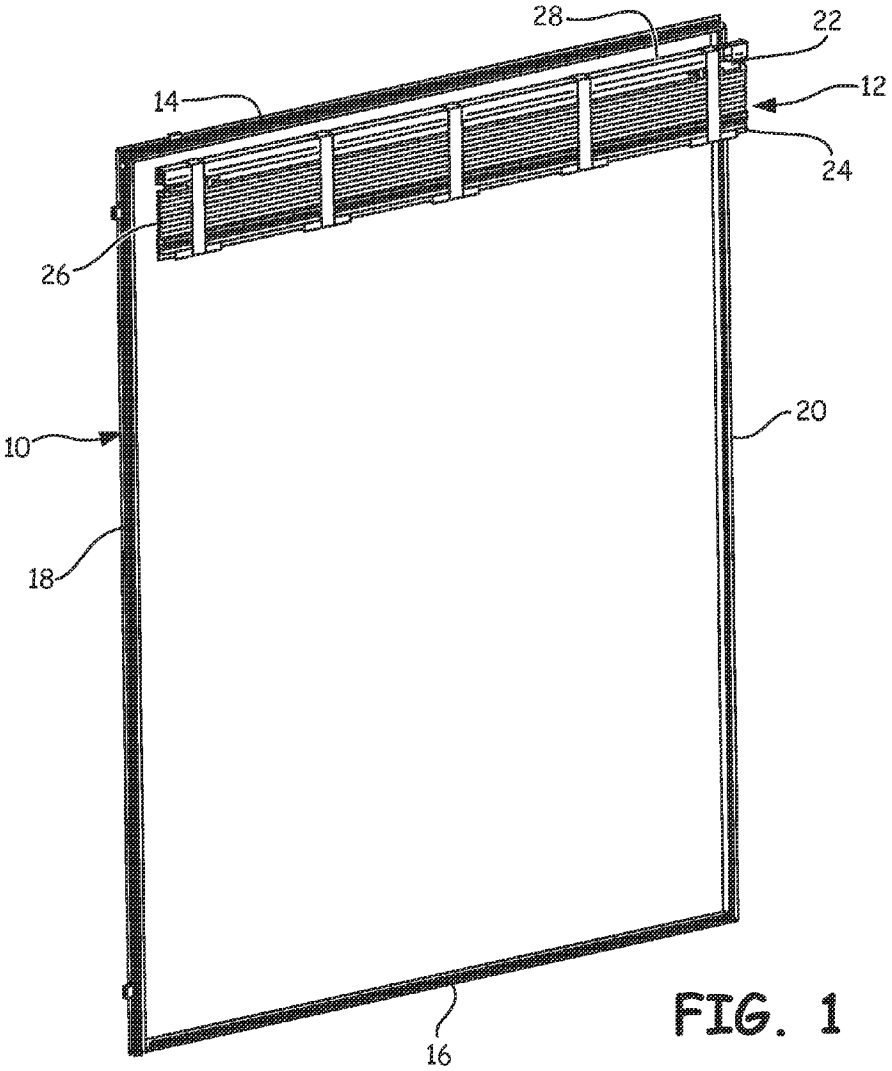
FIG. 1 is a perspective view of a fenestration and a shade system.

FIG. 1 is a perspective view of a fenestration 10 and a shade system 12. In the illustrated embodiment, the fenestration 10 is a window having a frame with a frame top 14, a frame bottom 16, and frame sides 18 and 20. In other embodiments, the fenestration 10 can be a door or other fenestration. The shade system 12 is a top-down shade system that includes a top rail 22, a bottom rail 24, and a shade 26 extending from the top rail 22 to the bottom rail 24. In the illustrated embodiment, the shade 26 is an accordion-type fabric shade having horizontally extending pleats. A mounting structure 28 is positioned above the top rail 22 for supporting the shade system 12. The mounting structure 28 is mountable to the frame top 14 between the frame sides 18 and 20. The mounting structure 28 contains a lift mechanism (not shown in FIG. 1) for lifting the top rail 22 and the shade 26. The bottom rail 24 can be mounted to the frame bottom 16 of the fenestration 10.

Figure 2:
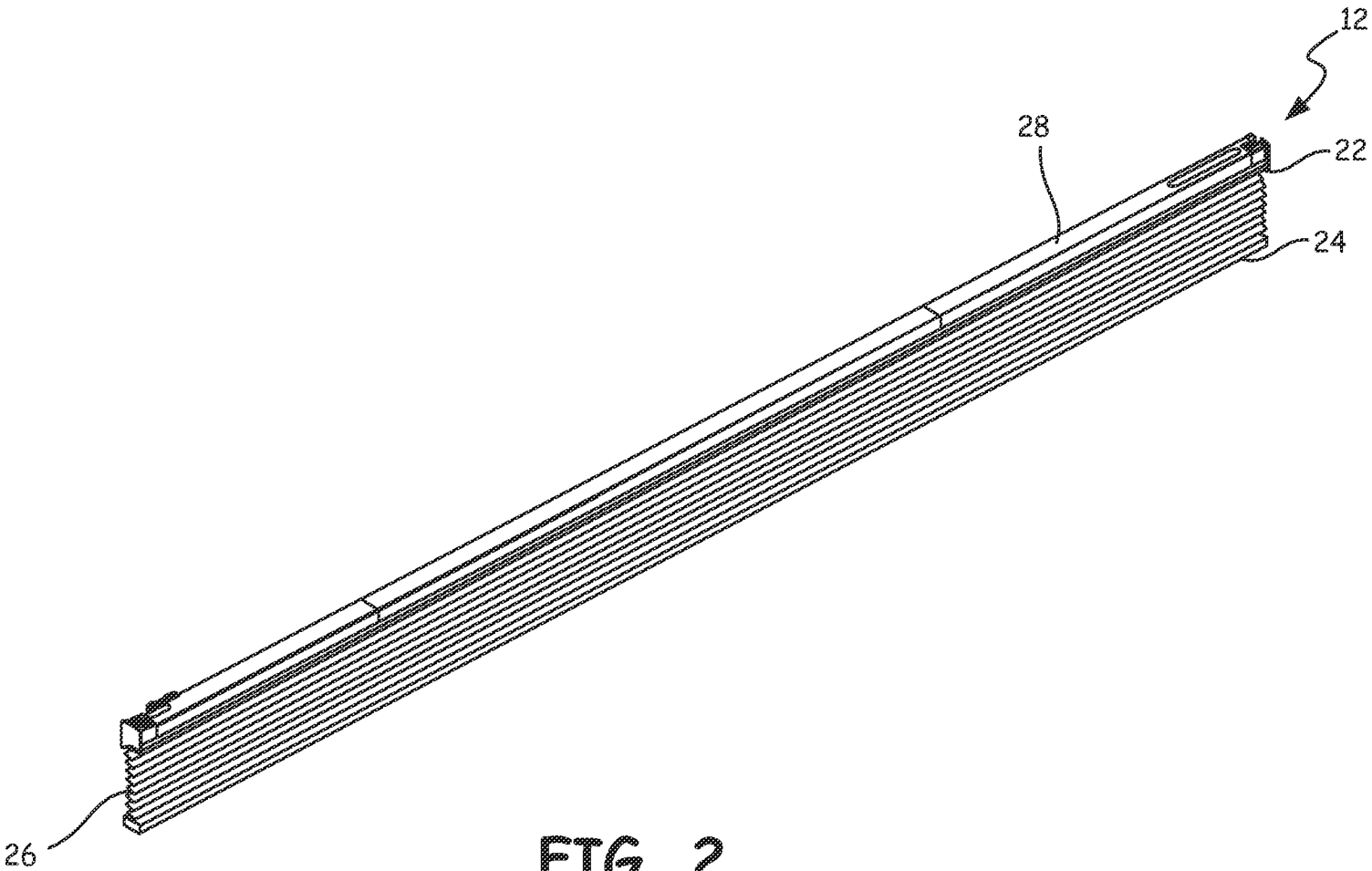
FIG. 2 is a perspective view of the shade system of FIG. 1.

FIG. 2 is a perspective view of the shade system 12. In FIG. 2, the shade system 12 is shown separate from the fenestration 12 (shown in FIG. 1).

Figure 3:
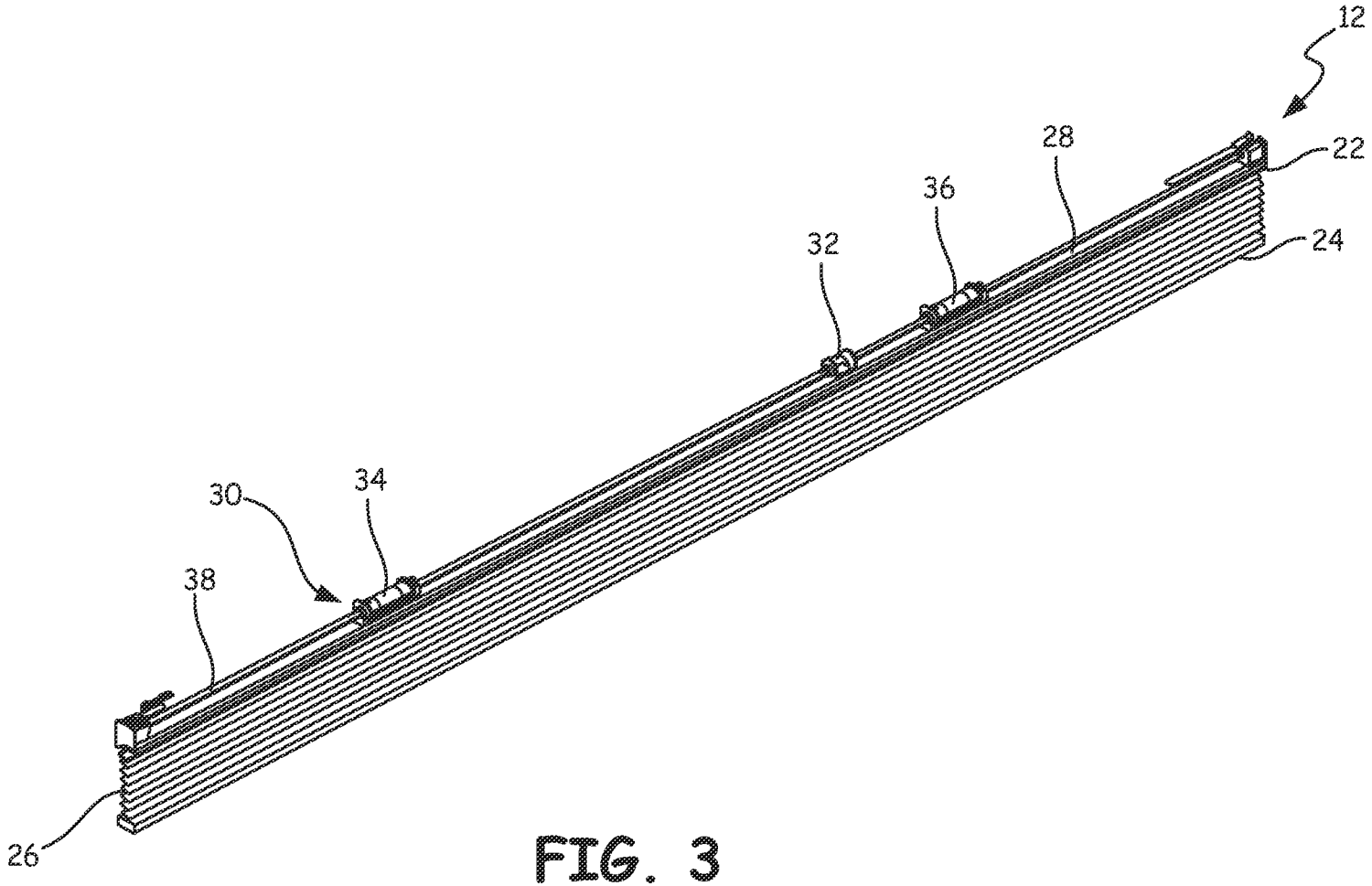
FIG. 3 is a perspective view of the shade system of FIGS. 1 and 2 with a mounting structure open.

FIG. 3 is a perspective view of the shade system 12 with the mounting structure 28 open. The mounting structure 28 contains a shade mechanism 30. The shade mechanism 30 includes a brake mechanism 32 as well as lift mechanisms 34 and 36 all mounted to and connected by a common horizontally extending shaft 38. In the illustrated embodiment, the shade mechanism 30 includes two lift mechanisms 34 and 36. In alternative embodiments, the shade mechanism 30 can include more or less than two lift mechanisms suitable for the application. Lift cords (not shown) are connected between the top rail 22 and each of the lift mechanisms 34 and 36. The lift mechanisms 34 and 36 can lift and lower the lift cords, thus raising and lowering the top rail 22 and the shade 26. When the shade 26 is raised or lowered to a desired height, the brake mechanism 32 can stop and hold the top rail 22 and the shade 26 at that height.

Figure 4:
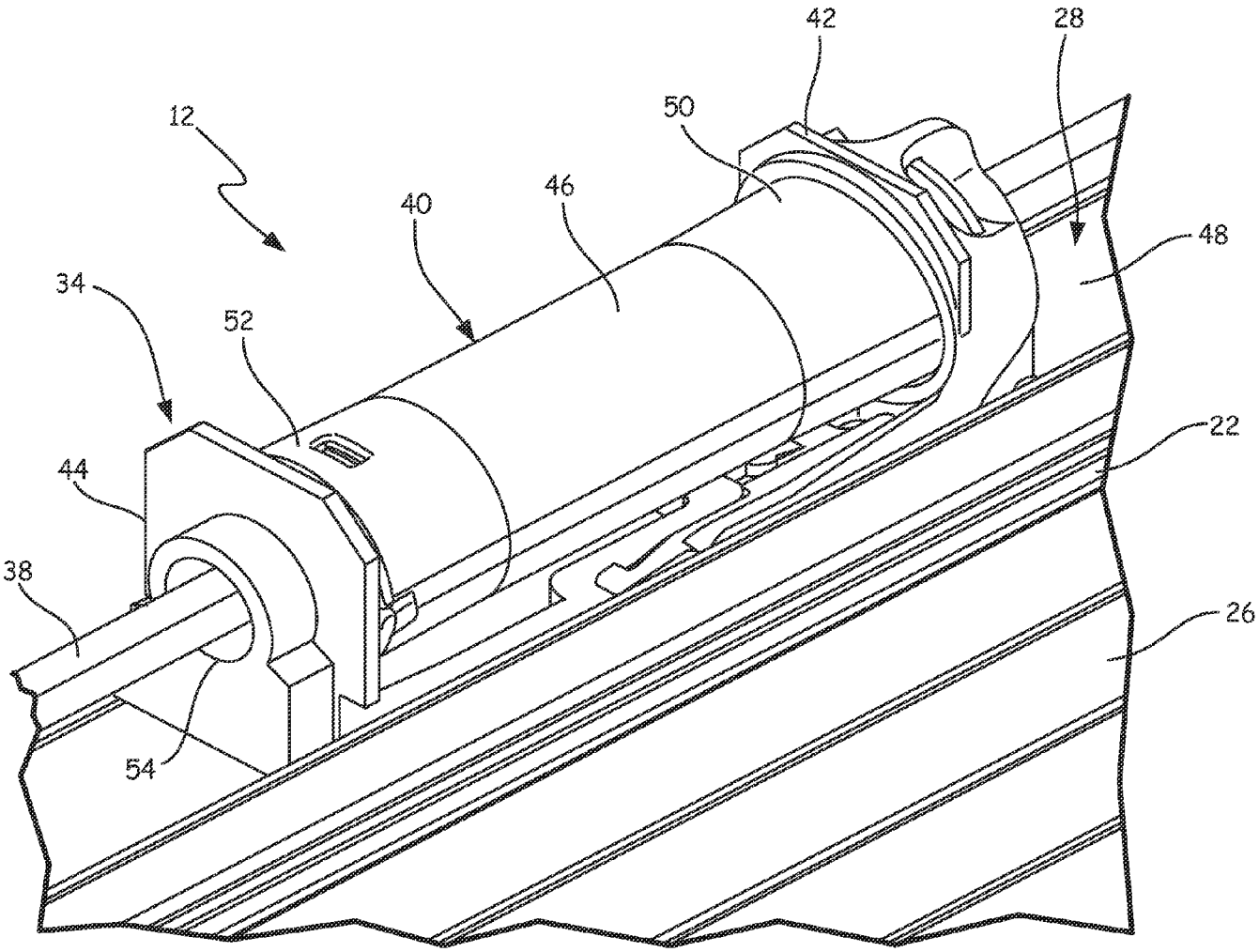
FIG. 4 is an enlarged perspective view of a lift mechanism used in the shade system of FIGS. 1-4.

FIG. 4 shows an enlarged perspective view of the lift mechanism 34. The lift mechanism 34 includes a lift spool 40, a spool base 42, and a spool retainer support 44. The lift spool 40 has a tapered cylinder 46 extending substantially axially. A lift cord (not shown) can be wrapped around the tapered cylinder 46 of the lift spool 40 for raising and lowering the top rail 22 and the shade 26 when the shaft 38 and the lift spool 40 rotate.

The spool retainer support 44 and the spool base 42 are mounted in a mounting channel 48 of the mounting structure 28 to rotatably support the lift spool 40 with respect to the top rail mounting structure 28. The spool base 42 rotatably supports a first end 50 of the lift spool 40. The spool retainer support 44 rotatably supports a second end 52 of the lift spool 40. The spool retainer support 44 includes an axially extending hole 54 sized larger than the shaft 38 to allow the shaft 38 to extend through and to rotate freely in the hole 54. The spool base 42 also includes an axially extending hole (not shown) sized larger than the shaft 38 to allow the shaft 38 to extend through and to rotate freely in the hole of the spool base 42.

Figure 5:
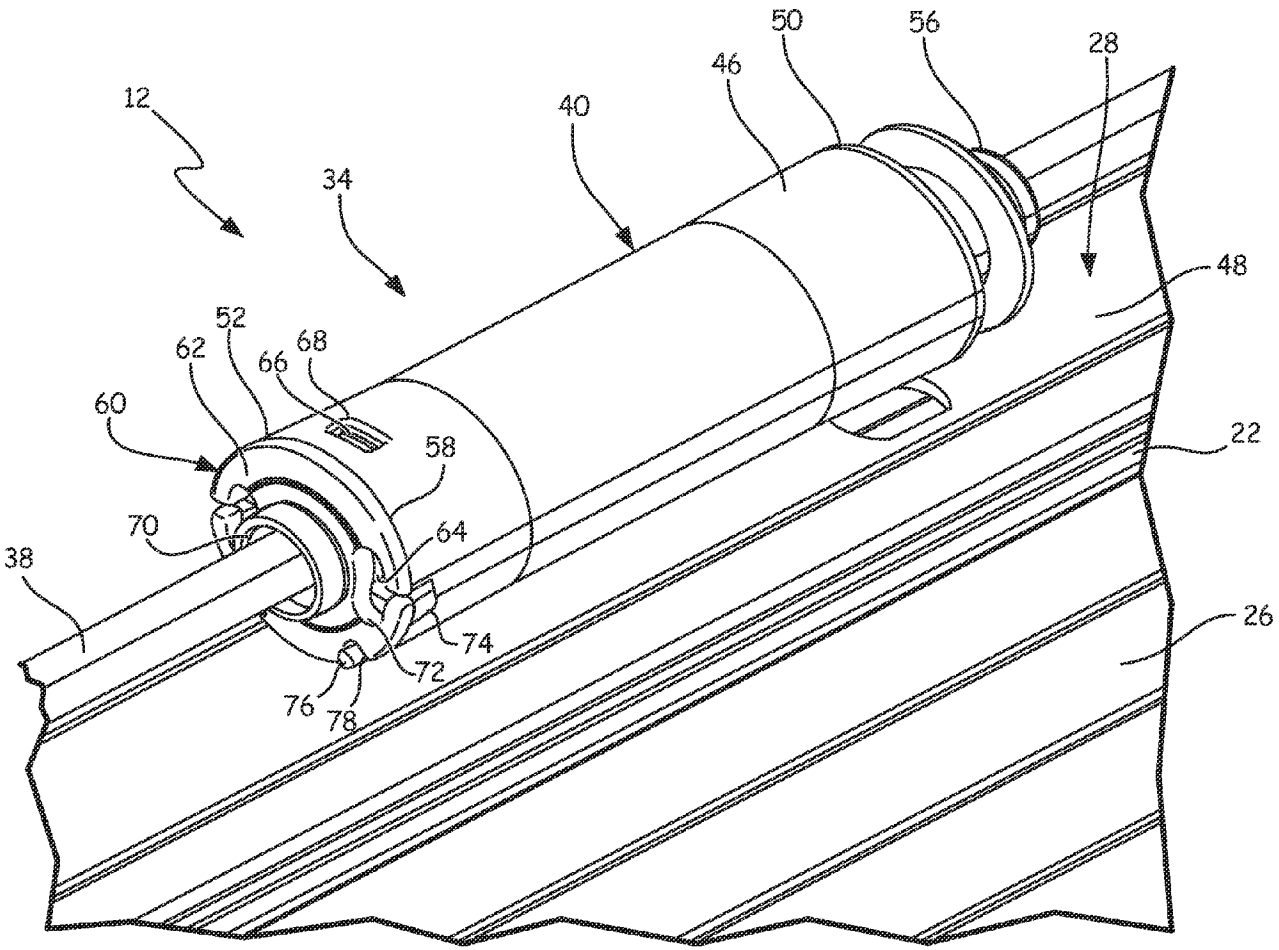
FIG. 5 is a perspective view of the lift mechanism of FIG. 3 with a spool base and a spool retainer support removed.

FIG. 5 is a perspective view of the lift mechanism 34 with the spool base 42 and the spool retainer support 44 (shown in FIG. 4) removed. The tapered cylinder 46 includes an axially extending hole 56 at the first end 50. The hole 56 is sized larger than the shaft 38 to allow the shaft 38 to extend through and to rotate freely in the hole 56. The tapered cylinder 46 also includes an axially extending hole 58 at the second end 52. The hole 58 is larger than the hole 56 and is sized to receive a cap and spring structure 60. The cap and spring structure 60 includes an end cap 62 and a resilient member 64. The resilient member 64 is largely obstructed from view in FIG. 5, as the tapered cylinder 46 acts as a spool cover to cover the resilient member 64.

The end cap 62 abuts and substantially covers the hole 58 of the tapered cylinder 46. The end cap 62 includes a lock tab 66 extending axially from the end cap 62 into the tapered cylinder 46. The lock tab 66 engages with a lock receptacle 68 defined by the tapered cylinder 46 to hold the end cap 62 to the tapered cylinder 46. The lock receptacle 68 extends radially through the tapered cylinder 46. The end cap 62 includes an axially extending hole 70 positioned in a center of the end cap 62. The hole 70 is sized larger than the shaft 38 to allow the shaft 38 to extend through and to rotate freely in the hole 70.

The end cap 62 also defines a knot slot 72 extending through the end cap 62. The knot slot 72 is substantially kidney-shaped and is sized to allow a knot of a lift cord (not shown) to pass there-through. The tapered cylinder 46 defines a lift cord slot 74 extending through the tapered cylinder 46. The lift cord slot 74 is sized to allow the lift cord to pass there-through but to obstruct or prevent the knot of the lift cord from passing there-through. The knot slot 72 is positioned adjacent the lift cord slot 74 to allow the knot of the lift cord to pass through the knot slot 72 and then get caught on the lift cord slot 74. The lift cord can then be wrapped around the tapered cylinder 46 with the knot held in place at the lift cord slot 74.

The tapered cylinder 46 includes a mating post 76 extending axially from the tapered cylinder. The end cap 62 includes a mating slot 78 positioned and sized to receive the mating post 76. The mating post 76 and the mating slot 78 combine to provide a keying function to align the end cap 62 with respect to the tapered cylinder 46.

Figure 6:
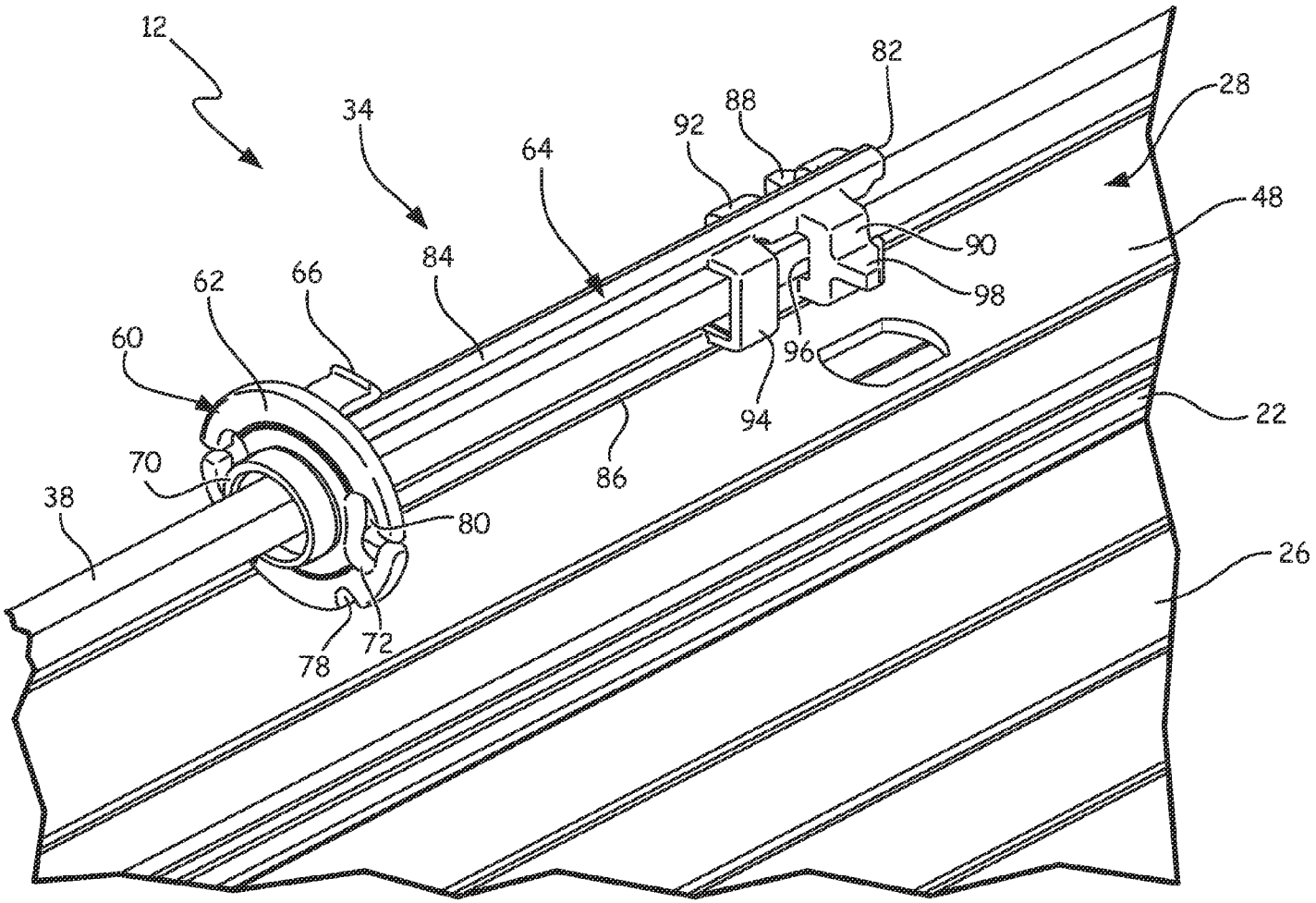
FIG. 6 is a perspective view of the lift mechanism of FIGS. 3-4 with a spool cover removed.

FIG. 6 is a perspective view of the lift mechanism 34 with the tapered cylinder 46 (shown in FIGS. 4 and 5) removed to expose the cap and spring structure 60. In the illustrated embodiment, the resilient member 64 is an axially elongate spring with a first end 80 and a second end 82. The resilient member 64 includes first and second axially extending and resilient member supports 84 and 86 extending from the first end 80 to the second end 82. The resilient member supports 84 and 86 are positioned on opposite sides of and extend substantially parallel to the shaft 38. The resilient member supports 84 and 86 can be spaced from the shaft 38 to allow for relative movement with respect to the shaft 38 while flexing in torsion. In some embodiments, the resilient member 64 can have more or less than two resilient member supports 84 and 86. In other embodiments, the resilient member 64 can include one or more coil springs and/or leaf springs.

The end cap 62 is rigidly attached at the first end 80 of the resilient member 64. In the illustrated embodiment, the end cap 62 and the resilient member 64 are integrally formed via injection molding with the resilient member supports 84 and 86 extending cantilevered from the end cap 62. In alternative embodiments, the end cap 62 and the resilient member 64 can be formed and connected via other means suitable for the application.

Connectors 88, 90, 92, and 94 are positioned at the second end 82 of the resilient member 64 for connecting the second end to the shaft 38. In the illustrated embodiment, the connectors 88, 90, 92, and 94 are brackets extending from the resilient member support 84 to the resilient member support 86. The connectors 88, 90, 92, and 94 are ordered alternatingly on opposite sides of the resilient member 64, with the connector 88 being nearest to the second end 82. The connectors 88 and 92 are positioned on one side of the resilient member supports 84 and 86 and the connectors 90 and 94 are positioned on an opposite side of the resilient member supports 84 and 86. The connectors 88, 90, 92, and 94 have inner surfaces 96 in abutting contact with the shaft 38 to hold the second end 82 substantially rigid with respect to the shaft 38. The shaft 38 and the inner surfaces 96 of the connectors 88, 90, 92, and 94 have a non-axisymmetric shape so that torque can be transmitted between the shaft 38 and the connectors 88, 90, 92, and 94. In alternative embodiments the quantity, configuration, and orientation of the connectors 88, 90, 92, and 94 can be modified as appropriate for the application. For example, the connectors 88, 90, 92, and 94 could be replaced or supplemented by bolts, screws, or adhesive.

A stop 98 extends radially outward from the bracket 90. The stop 98 can engage one or more stops (not shown) extending radially inward from an inner surface of the tapered cylinder 46 when the shaft 38 rotates with respect to the tapered cylinder 46. The stop 98 can provide an angular limit to relative angular rotation between the shaft 38 and the tapered cylinder 46. In an alternative embodiment, one or more stops 98 can be positioned on the resilient member 64 near the second end 82 of the resilient member 64 in addition to or instead of positioning the stop 98 on the bracket 90.

In operation, rotation of the shaft 38 can apply a force on the second end 82 of the resilient member 64, which translates through the resilient member 64 to the end cap 62, to the tapered cylinder 46, to the lift cord, and to the top rail 22 and the shade 26 to lift the top rail 22 and the shade 26. Rotation of the shaft 38 in an opposite direction can rotate the cap and spring structure 60 and the tapered cylinder 46 to lower the top rail 22 and the shade 26. Thus, force between the shaft 38 and the tapered cylinder 46 can be transmitted through the cap and spring structure 60, without any direct connection between the shaft 38 and the tapered cylinder 46. In one embodiment, the holes 54, 56, and 70 can be spaced from the shaft 38 such that there is little or no contact with the shaft 38 at those locations. In another embodiment, the shaft 38 can have at least some contact with one or more of the holes 54, 56, and 70 and yet still rotate freely within the holes 54, 56, and 70.

When a user desires to lift the shade 26, the user can cause rotation of the shaft 38 (for example, via a draw string, not shown) to actuate the lift mechanism 34. When the shaft 38 stops rotating, the brake 32 can engage to hold the shaft 38. While the brake 32 is engaging, the shaft 38 can be allowed to rotate slightly, which can allow the top rail 22 and the shade 26 to stop slightly lower than desired. This can undesirably create a gap, such as a gap of about ⅛ inch, between the top rail 22 and the mounting structure 28 that allows light to pass. Such a light gap can be reduced or eliminated via the lift mechanism 34 by allowing over-rotation of the shaft 38.

When the top rail 22 is raised to abut the mounting structure 28, the lift cord can become taught and cease rotation of the tapered cylinder 46. Because the cap and spring structure 60 is flexible, the shaft 38 can be allowed to continue rotation, or over-rotate, further than the tapered cylinder 46. By over-rotating the shaft 38, the resilient member 64 can continue to apply a force to hold the top rail 22 against the mounting structure 28 even after the shaft 38 is allowed to rotate slightly backwards while the brake 32 is engaging. In the illustrated embodiment, the resilient member 64 allows the shaft 38 to over-rotate by about 150 degrees. In other embodiments, the resilient member 64 can allow for over rotation by an amount that is more or less than 150 degrees, so long as the resilient member 64 allows for over-rotation by at least 30 degrees. In further alternative embodiments, the resilient member 64 can allow for over-rotation by another amount suitable for the application. This can yield a relatively simple, reliable, and convenient shade mechanism 30 that can lift and hold a top rail of a top-down shade system with little or no light gap above the top rail.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A window covering for a fenestration product having a viewing area, the window covering comprising:

a top rail;

a bottom rail;

a shade extending between the top rail and the bottom rail; and a shade mechanism comprising:

a rotatable lift shaft;

a lift spool having a cylinder operably connected to the top rail for raising and lowering the top rail; and a resilient member operably connected between the lift shaft and the lift spool, wherein the resilient member allows the lift shaft to over-rotate with respect to the lift spool.

2. The window covering of claim 1, wherein the resilient member is axially elongate with a first end connected to the cylinder and a second end connected to the rotatable lift shaft.

3. The window covering of claim 2, wherein the resilient member comprises a stop extending from the second end of the resilient member and engagable with a portion of the lift spool to limit relative angular rotation between the lift shaft and the lift spool.

4. The window covering of claim 1, wherein the resilient member is connected to the cylinder via an end cap connected to an end of the cylinder.

5. The window covering of claim 4, wherein the end cap defines an end cap hole, wherein the cylinder defines a cylinder hole at a second end of the cylinder, wherein the lift shaft extends through the end cap hole with little or no contact between the lift shaft and the end cap at the end cap hole, and wherein the lift shaft extends through the cylinder hole with little or no contact between the lift shaft and the cylinder at the cylinder hole.

6. The window covering of claim 4, wherein the end cap defines a substantially kidney-shaped knot slot, wherein the cylinder defines a lift cord slot adjacent the knot slot, and wherein a knotted lift cord extends through the lift cord slot with a knot of the knotted cord held in place at the lift cord slot.

7. The window covering of claim 4, wherein the end cap includes a lock tab extending axially from the end cap and engaged with the cylinder at a lock receptacle defined by the cylinder.

8. The window covering of claim 1, wherein a first resilient member end of the resilient member is connected to a first cylinder end of the cylinder and wherein a second resilient member end of the resilient member extends into the cylinder toward a second cylinder end of the cylinder.

9. The window covering of claim 1, wherein the resilient member comprises first and second resilient member supports positioned on opposite sides of and extending substantially parallel to the lift shaft.

10. The window covering of claim 9, wherein the resilient member is connected to the lift shaft via a plurality of brackets, each extending from the first resilient member support to the second resilient member support.

11. The window covering of claim 1, wherein the lift spool includes a lift cord wrapped around the lift spool and connected to the top rail for raising and lowering the top rail.

12. The window covering of claim 1, wherein the lift spool does not contact the lift shaft except through the resilient member.

13. The window covering of claim 1, wherein the shade mechanism is positioned on a mounting structure positioned above the top rail and wherein the top rail can be raised and lowered with respect to the mounting structure when the mounting structure is mounted to a window frame.

14. The window covering of claim 1, and further comprising:

a brake attached to the lift shaft and engagable to stop rotation of the lift shaft to hold the top rail and the shade at a selectable position.

15. A top-down shade system comprising:

a top rail extending substantially horizontally;

a bottom rail extending substantially horizontally;

a shade extending between the top rail and the bottom rail;

a mounting structure positioned above the top rail; and a shade mechanism positioned at least partially in the mounting structure, the shade mechanism comprising:

a rotatable lift shaft;

a lift spool having a cylinder connected to the top rail via a lift cord wrapped around the cylinder; and a resilient member operably connected between the lift shaft and the lift spool, wherein the resilient member allows the lift shaft to over-rotate with respect to the lift spool.

16. The window covering of claim 15, wherein the resilient member is axially elongate with a first end connected to the cylinder via an end cap and a second end connected to the rotatable lift shaft.

17. The window covering of claim 15, wherein a first resilient member end of the resilient member is connected to a first cylinder end of the cylinder and wherein a second resilient member end of the resilient member extends into the cylinder toward a second cylinder end of the cylinder.

18. The window covering of claim 15, wherein the resilient member comprises first and second resilient member supports positioned on opposite sides of, spaced from, and extending substantially parallel to the lift shaft.

19. The window covering of claim 15, and further comprising:

a brake attached to the lift shaft and engagable to stop rotation of the lift shaft to hold the top rail and the shade at a selectable position.

20. A method of operating the window covering of claim 1 having the shade extending between the top rail and the bottom rail, the method comprising:

rotating in a first direction the lift shaft and the cylinder operably connected by the resilient member;

raising the top rail to abut a structure above the top rail via the lift cord operably connected between the top rail and the cylinder; and over-rotating the lift shaft with respect to the cylinder by bending the resilient member to maintain tension in the lift cord.

21. The method of claim 20, and further comprising:

allowing the lift shaft to rotate slightly in a second direction opposite the first direction; and braking rotation of the lift shaft, wherein force of the resilient member holds the top rail against the support structure after braking rotation of the lift shaft.

* * * * *